US005395014A

United States Patent [19]

Burrows

[11] Patent Number: 5,395,014

[45] Date of Patent: Mar. 7, 1995

[54] BOTTLED WATER STATION WITH SWEAT-FREE DISPENSER FAUCET

[75] Inventor: Bruce D. Burrows, Valencia, Calif.

[73] Assignee: Ebtech, Inc., Columbus, Ohio

[21] Appl. No.: 202,721

[22] Filed: Feb. 28, 1994

[51] Int. Cl.[6] ..... B67D 5/62

[52] U.S. Cl. ..... 222/146.6; 222/185; 62/390

[58] Field of Search ..... 222/146.1, 146.6, 185; 62/390, 395

[56] References Cited

U.S. PATENT DOCUMENTS

| | | | |
|---|---|---|---|
| 4,902,320 | 2/1990 | Schroer et al. | 222/185 |
| 5,105,858 | 4/1992 | Levinson | 222/185 |
| 5,192,004 | 3/1993 | Burrows | 222/185 |
| 5,246,141 | 9/1993 | Burrows | 222/185 |
| 5,307,958 | 5/1994 | Burrows | 222/146.6 |

*Primary Examiner*—Andres Kashnikow
*Assistant Examiner*—Philippe Derakshani
*Attorney, Agent, or Firm*—Kelly Bauersfeld & Lowry

[57] ABSTRACT

A bottled water station includes an improved dispenser faucet for use in dispensing chilled water from a station reservoir, wherein the improved faucet is designed to substantially eliminate formation of condensation on externally exposed surfaces of the faucet structure. The dispenser faucet comprises a delivery conduit having a rear end adapted for removable mounting onto the reservoir and a front end projecting forwardly therefrom to a spigot having a manually operable valve member. The front end of the delivery conduit is surrounded for a substantial portion of the length thereof by a substantially sealed annular air gap wherein this air gap provides an insulation chamber which is effective to reduce or eliminate condensation on exposed external surfaces of the faucet.

14 Claims, 4 Drawing Sheets

FIG. 5
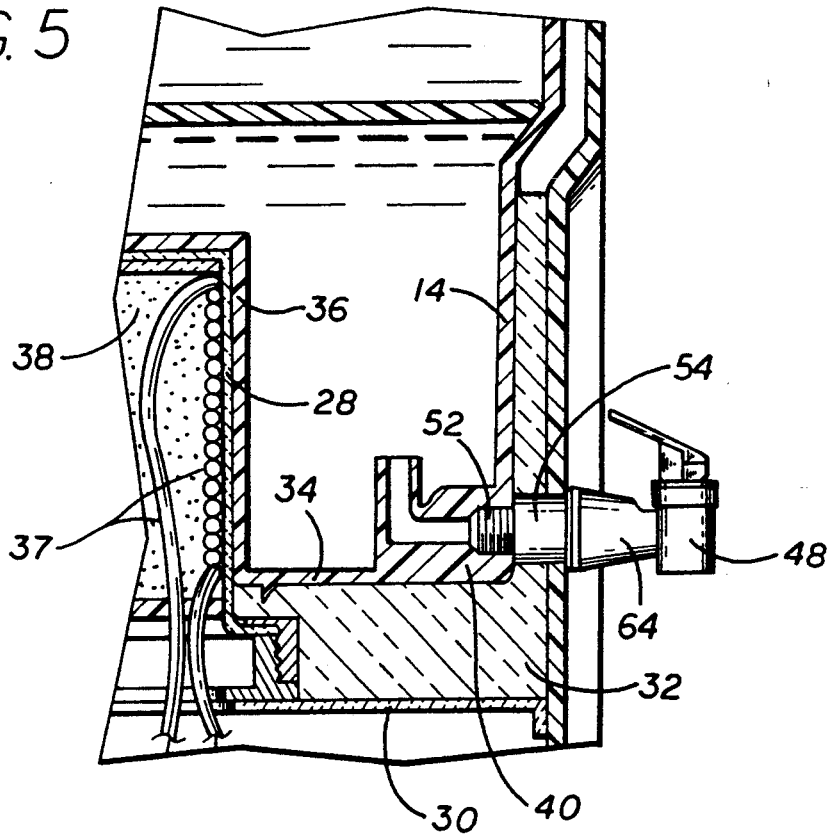
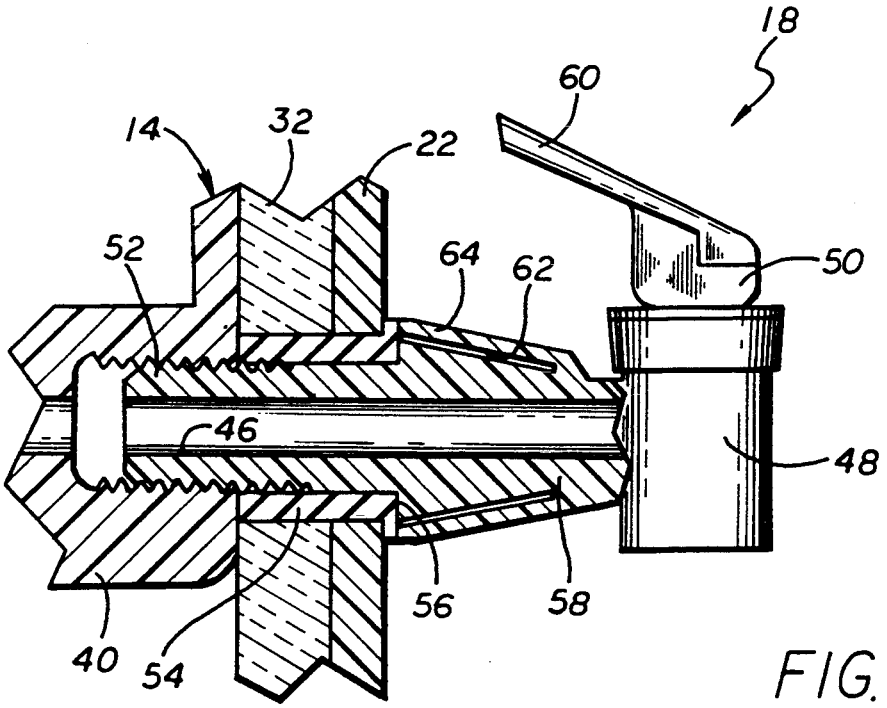
FIG. 6

BOTTLED WATER STATION WITH SWEAT-FREE DISPENSER FAUCET

BACKGROUND OF THE INVENTION

This invention relates generally to improvements in bottled water stations of the type adapted to receive and support a water bottle in an inverted position over a station reservoir, and to selectively dispense water from the station reservoir. More specifically, this invention relates to an improved dispenser faucet for use in dispensing chilled water from the station reservoir, wherein the dispenser faucet is designed to substantially reduce or eliminate formation of undesired condensation on exposed external surfaces of the faucet.

Bottled water dispenser stations are well-known in the art for containing a supply of relatively purified water in a convenient manner and location ready for substantially immediate dispensing and use. Such bottled water stations commonly include an upwardly open reservoir mounted within a station housing and adapted to receive and support an inverted water bottle of typically three to five gallon capacity. The water within the inverted bottle flows downwardly into the station reservoir for selective dispensing therefrom through a faucet valve located in an accessible position on the front of the station housing. Such bottled water stations are widely used to provide a clean and safe source of water for drinking and cooking, especially in areas where the local water supply is suspected to contain undesired levels of contaminants.

In many bottled water station designs, a refrigeration system is mounted within the station housing and includes a chiller coil for maintaining water within the reservoir in a chilled condition. In other configurations, the reservoir is subdivided into distinct chambers, one of which is associated with the refrigeration system, whereas the other chamber contains unrefrigerated water substantially at room temperature. In bottled water stations of the latter type, separate dispenser faucet valves are provided in flow communication with the two reservoir chambers to permit separate dispensing of chilled water and room temperature water. In still further designs, the bottled water station sometimes includes an auxiliary reservoir provided with suitable heating elements to produce a hot water supply which can be dispensed through a separate faucet valve.

The provision of a chilled water supply, by itself or in combination with water supplies at other temperatures, is a highly desirable feature in a bottled water station particularly to meet the demand for refreshing drinking water or other chilled beverages. However, the presence of the chiller coil and the associated body of chilled water results in potential formation of condensation on external surfaces of the reservoir and other station components in thermal communication with the chiller coil. Formation of condensation can be substantial, particularly in warm and humid climates, resulting in undesirable condensate dripping and/or water puddling on the floor beneath the station housing.

Recent designs for improved bottled water stations have been proposed to reduce and/or eliminate condensation on the exterior of a chilled reservoir within the station housing. See, for example, U.S. Pat. No. 5,192,004. However, condensation problems are sometimes still encountered with respect to externally exposed surfaces of the dispenser faucet used to dispense water from the chilled reservoir. In addition, similar condensation problems can be encountered with respect to other dispenser faucets used for dispensing water at other temperatures, but wherein such faucet or faucets are associated with a flow tube extending through or in close association with the chilled reservoir. Once again, such condensate formation can be particularly severe in warm and humid climates. Prolonged dampness on the dispenser faucets, attributable to condensation, can result in undesirable and highly unsightly formation of a mildew-type mold.

The present invention provides an improved dispenser faucet for use with a bottled water station of the type having chilled water within a station reservoir, wherein the dispenser faucet is constructed to reduce or eliminate condensation on externally exposed surfaces of the faucet structure.

SUMMARY OF THE INVENTION

In accordance with the invention, an improved dispenser faucet is provided for use with a bottled water station of the type having a reservoir for receiving and storing a supply of chilled water. The reservoir is mounted within a station housing with at least a portion thereof in thermal communication with a chiller coil to refrigerate water within the reservoir. The dispenser faucet valve is connected to the reservoir and protrudes forwardly therefrom at the front of the station housing to permit dispensing of the chilled water. The dispenser faucet includes air gap means to reduce or eliminate condensate formation on exposed external faucet surfaces.

In the preferred form, the dispenser faucet comprises a delivery conduit having a rear end defined by a threaded nipple for removable connection to a threaded faucet fitting on the station reservoir. This threaded nipple is receivable through aligned faucet ports in a front wall of the station housing and insulation material surrounding the reservoir, for thread-in mounting into the faucet fitting. A front end of the delivery conduit protrudes a short distance forward from the front wall of the station housing, terminating at a spigot having a manually operable valve member for use in dispensing water from the reservoir.

When the dispenser faucet is mounted onto the bottled water station, as described above, a resilient seal bushing is axially compressed between a raised annular shoulder on the delivery conduit and a front face of the faucet fitting to ensure leak-free flow of water through the delivery conduit to the spigot. In accordance with the invention, the front end of the delivery conduit includes an annular, axially elongated air gap which extends a substantial portion of the length of the conduit front end, wherein this air gap opens rearwardly within the plane of the raised annular shoulder. When the faucet is mounted onto the station housing, the resilient seal bushing effectively closes and seals the air gap. The thus-sealed air gap, surrounding a substantial portion of the front end of the delivery conduit, has been found effective in substantially eliminating condensate formation on externally exposed surfaces of the faucet.

The improved dispenser faucet including the annular air gap, as described above, is beneficially used to dispense water at different temperatures from the bottled water station, when water supplies at different temperatures are provided. In such bottled water stations, each alternative temperature water supplies is normally associated with a flow tube extending through or in close proximity with the chilled water supply. Use of the improved dispenser faucet including the air gap effectively prevents condensate formation attributable to thermal communication of the dispenser faucet with the chilled water supply.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 5 is an enlarged fragmented vertical sectional view taken generally on the line 5—5 of FIG. 1, and illustrating the removable reservoir installed into the station housing;

FIG. 6 is a further enlarged and fragmented vertical sectional view generally corresponding with a portion of FIG. 5, and illustrating construction details of the improved dispenser faucet.

DETAILED DESCRIPTION OF THE PREFERRED EMBODIMENT

Figure 1:
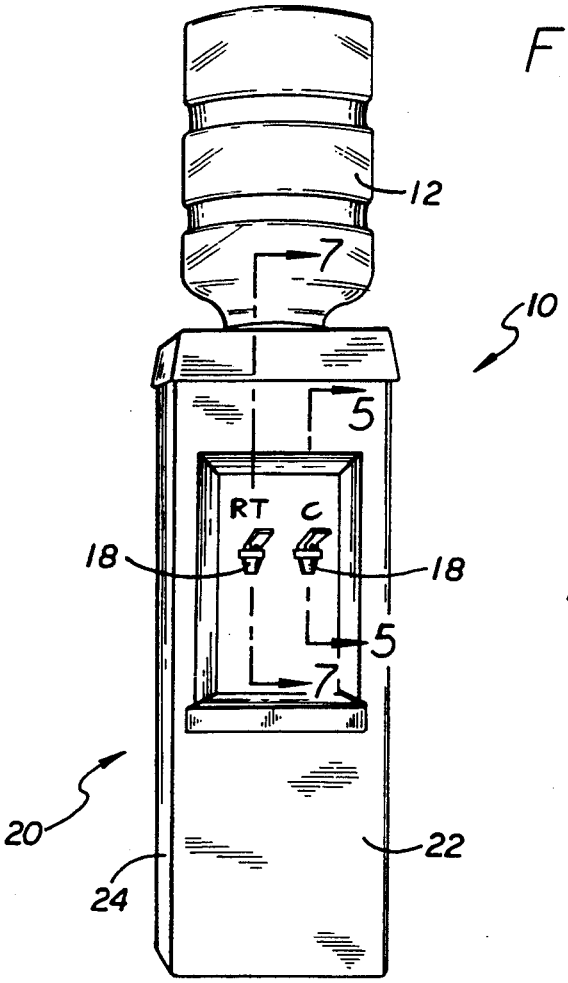
FIG. 1 is a perspective view illustrating a bottled water dispenser station equipped with improved sweat-free dispenser faucets embodying the novel features of the invention.
Figure 7:
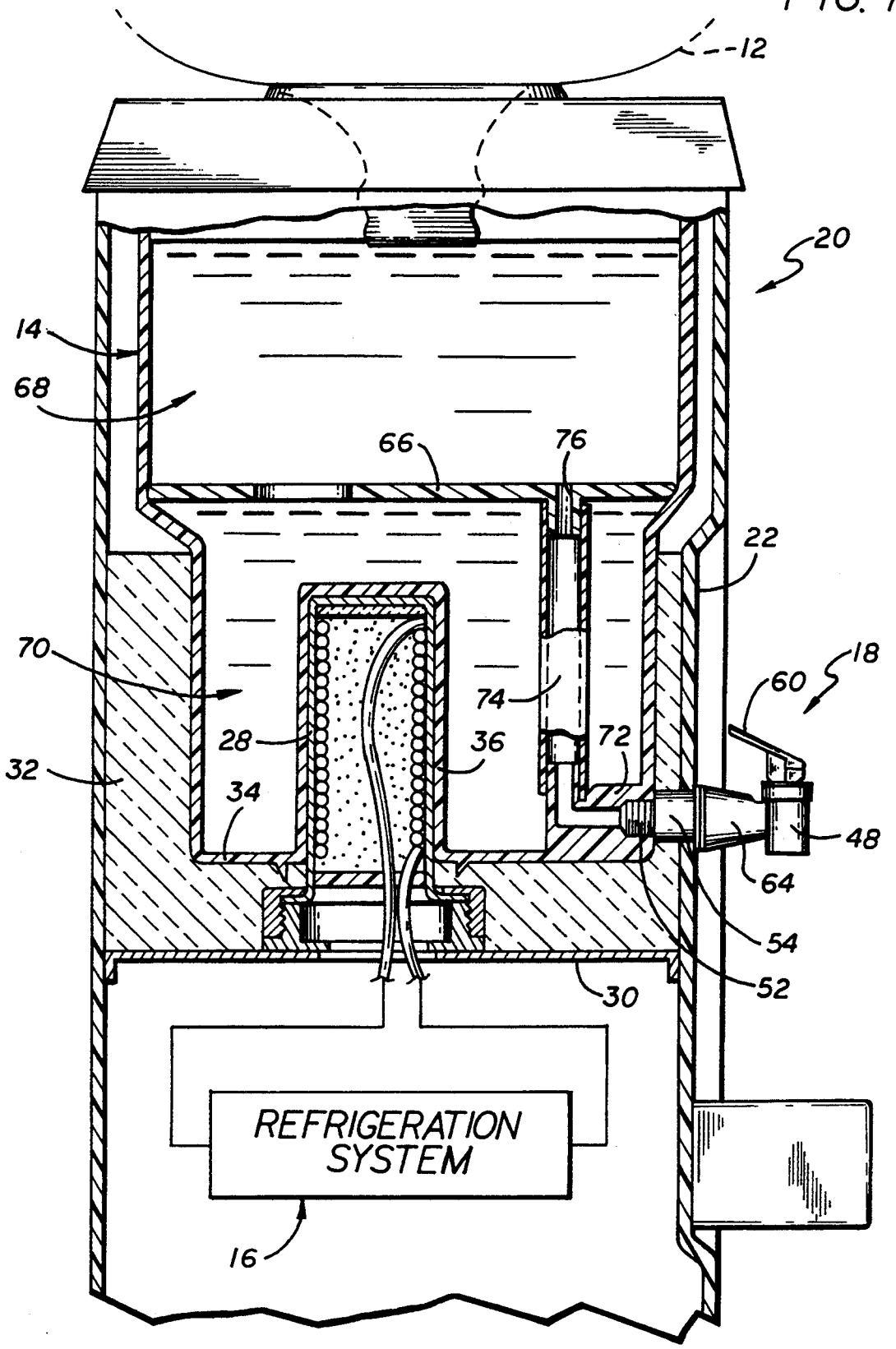
FIG. 7 is an enlarged fragmented vertical sectional view taken generally on the line 7—7 of FIG. 1.

As shown in the exemplary drawings, a bottled water station referred to generally in FIG. 1 by the reference numeral 10 is provided for receiving and supporting a water bottle 12 containing a supply of relatively purified water for drinking and cooking uses, etc. The bottled water station 10 includes a reservoir 14 for receiving and storing water flowing downwardly from the water bottle 12, in combination with a refrigeration system 16 (FIGS. 2, 4 and 7) for chilling water within the reservoir 14. An improved dispenser faucet 18, two of which are shown in the illustrative drawings, is provided for dispensing water from the reservoir 14, wherein the improved dispenser faucet 18 is designed to reduce or eliminate formation of condensation on exposed external faucet surfaces.

Figure 2:
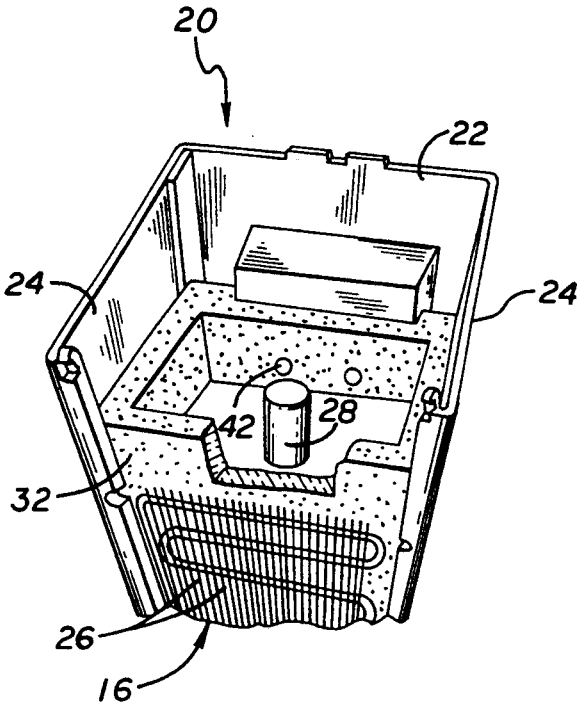
FIG. 2 is a fragmented and enlarged rear perspective view of the station housing, with a water-containing station reservoir removed therefrom.

The illustrative bottled water station 10 has a generally conventional overall size and shape to include an upstanding station cabinet or housing 20. The housing 20 has a generally rectangular configuration to include a front wall 22 joined to a pair of housing side walls 24, and a housing back which has a typically open construction (FIG. 2). The refrigeration system 16 is normally mounted within a lower portion of the housing interior and includes finned heat transfer tubing 26 mounted across the open back of the station housing 20. The refrigeration system also includes, in the illustrative embodiment of the invention, a cylindrical chiller probe 28 which projects upwardly from a generally horizontal support platform 30 mounted within the station housing 20 at a position spaced below the housing upper end. As shown in FIG. 2, the support platform 30 cooperates with the housing walls and an upwardly open, generally box-shaped insulated receptacle 32 to define an upwardly open cavity for drop-in and slide-fit removable mounting of the reservoir 14.

Figure 3:
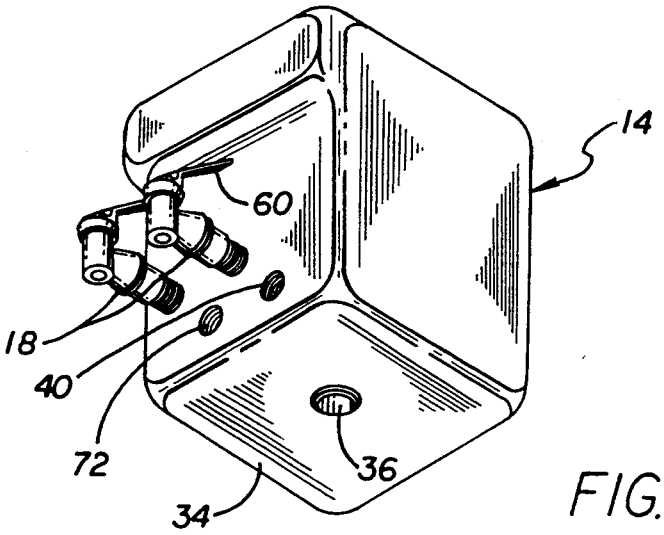
FIG. 3 is an enlarged bottom perspective view depicting the removable station reservoir in exploded relation with dispenser faucets embodying the invention.
Figure 4:
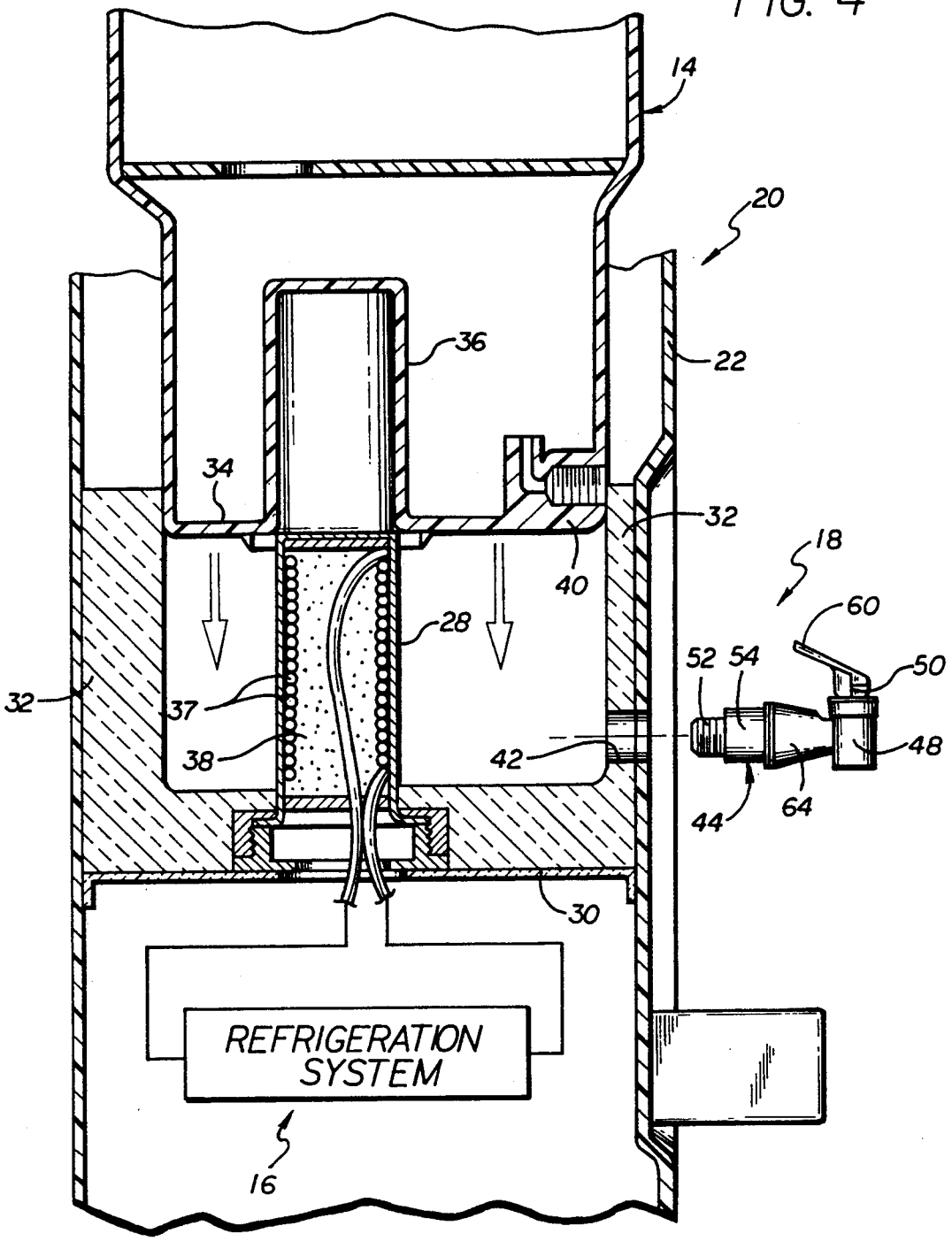
FIG. 4 is an enlarged fragmented vertical sectional view illustrating slide-in installation of the reservoir of FIG. 3 into the station housing.

As shown in FIGS. 3 and 4, the reservoir 14 includes a bottom wall 34 having an upwardly projecting, downwardly open receiver cup 36 formed therein. When the reservoir 14 is slide-fitted into the station housing 20, as viewed in FIG. 4, the receiver cup 36 is slidably fitted in close conformance about the upwardly projecting chiller probe 28. With this construction, the chiller probe 28 is positioned in thermal communication with water disposed within the station reservoir 14 to cool or chill the water to a pleasing and refreshing beverage temperature. In this regard, the refrigeration system 16 includes a chiller coil 37 wrapped specifically within the probe 28, and heat transfer communication between the coil 37 and the water within the reservoir is enhanced by filling the residual volume of the chiller probe 28 with a thermal mastic material 38 in the form of a viscous or gel material chosen for relatively efficient heat transfer properties, such as a polymeric heat transfer compound of the type marketed by Presstite Division of Inmont Corporation, St. Louis, Mo., under the name Presstite Thermal Mastic. Further constructional details of the chiller probe 28 and/or reservoir geometries for mated heat transfer mounting may be found by reference to U.S. Pat. No. 5,192,004 and U.S. Pat. No. 5,246,141, which are incorporated by reference herein.

A threaded faucet fitting 40 is formed on or otherwise mounted onto the reservoir 14 near the bottom wall 34, as shown in FIGS. 4 and 5. When the reservoir 14 is fully installed into the station housing, the faucet fitting 40 is disposed in alignment with an open faucet port 42 formed to extend through the insulated receptacle 32 and the front wall 22 of the station housing. One of the dispenser faucets 18 is removably mounted through the faucet port 42 for thread-in connection with the faucet fitting 40, whereupon the dispenser faucet 18 can be manually operated for selectively dispensing chilled water from the reservoir 14.

More specifically, as shown best in FIG. 6, the dispenser faucet 18 comprises a delivery conduit 44 having an internal flow path 46 leading to a vertically oriented spigot 48 having a manually operated valve member 50. The delivery conduit 44, which is preferably constructed as a unitary plastic molding, includes a rear end 52 defining an externally threaded nipple having a size and shape for reception rearwardly through the faucet port 42 and thread-in connection to the faucet fitting 40. A resilient seal bushing 54 is carried about the rear end 52 of the faucet 18 within the faucet port 42, in a position for axial compression between the faucet fitting 40 and a diametrically enlarged or raised annular shoulder 56 on the dispenser faucet. This bushing 54 provides an effective seal between the faucet and the reservoir to prevent water leakage past the exterior surfaces of the faucet 18, thereby confining water discharge flow through the flow path 46 of the delivery conduit 44.

The delivery conduit 44 of the dispenser faucet 18 further includes a front end 58 which projects outwardly or forwardly a short distance from the front wall 22 of the station housing. The front end 58 is joined to the spigot 48 having the manually operated valve member 50 installed therein. Manual actuation of the valve member 50 by operation of a valve handle 60 is effective to open the spigot and dispense water from the reservoir 14 through the delivery conduit.

In accordance with a primary aspect of the present invention, the front end 58 of the delivery conduit 44 includes an annular air gap 62 surrounding a substantial portion of the externally exposed conduit length. More particularly, the front end segment 58 of the delivery conduit 44 is formed to include an annular outer sleeve 64 joined to the delivery conduit 44 at a position near the spigot 48. The sleeve 64 extends rearwardly in circumferentially spaced relation about the front end of the delivery conduit, thereby defining the annular air gap 62, with a rearmost end of the sleeve 64 terminating generally by coplanar relation with and thus defining an effective continuation of the raised shoulder 56. Installation of the dispenser faucet 18 onto the station housing by thread-in connection with the faucet fitting 40 results in engagement of the seal bushing 54 with the shoulder 56 and the rear edge of the outer sleeve 64, such that the seal bushing 54 bridges and substantially closes and seals the air gap 62.

In use, the air gap 62 effectively insulates a substantial portion of the forwardly projecting delivery conduit. The outer sleeve 64 is joined to the inner conduit structure by a thin web of material spaced a significant distance from the reservoir 14, such that the outer sleeve 64 effectively remains substantially at room temperature to prevent formation of condensation thereon. The portion of the delivery conduit surrounded by the air gap 62 is thermal communication with the chilled water, but has no externally exposed surface such that condensation does not form. The spigot 48 and its valve member 50 are spaced sufficiently from the reservoir 14 such that significant condensation on external spigot surfaces generally does not occur.

The improved dispenser faucet 18 of the present invention may be used beneficially in dispensing of an alternative water supply at a different temperature, wherein flow tube components associated with the alternative water supply are otherwise subjected to reduced temperatures within the chilled reservoir 14. In particular, with reference to FIG. 7, a baffle plate 66 may be provided within the reservoir 14 for subdividing the reservoir interior into upper and lower chambers 68 and 70, respectively. In this configuration, water within the lower reservoir chamber 70 is in close thermal exchange with the chiller probe 28 and is dispensed as previously described with respect to FIGS. 4–6. By contrast, water within the upper reservoir chamber 68 is effectively or substantially isolated from the chiller probe 28, and is thus maintained at a substantially higher, approximate room temperature level. A second threaded faucet fitting 72 is provided on the reservoir 14 and adapted for connection via a standpipe 74 through an aperture 76 in the baffle plate 66 for use in dispensing the room temperature water. A second dispenser faucet 18 constructed and mounted in the same manner as described previously herein is thread-in mounted with the faucet fitting 72 for use in dispensing the room temperature water. Since the fitting 72 and standpipe 74 are exposed to the chilled water within the lower chamber 68, the provision of the air gap 56 in this second dispenser faucet beneficially prevents condensate formation on exposed external surfaces of the faucet structure.

The improved dispenser faucet of the present invention is particularly suited for use in warm and humid climates wherein condensate can form quickly and in substantial quantities, resulting in potential mold and/or mildew problems, and undesired or uncontrolled water dripping outside the bottled water station.

A variety of further modifications and improvements to the dispenser faucet shown and described herein will be apparent to those persons skilled in the art. Accordingly, no limitation on the invention is intended by way of the foregoing description and accompanying drawings, except as set forth in the appended claims.

What is claimed is:

1. A water station, comprising:

a reservoir having a hollow interior for receiving and storing a supply of water;

a station housing having support means for receiving and supporting said reservoir:

chiller means within said station housing to chill water within said reservoir; and faucet means for dispensing water from said reservoir, said faucet means including a delivery conduit projecting outwardly from said reservoir, a spigot having a valve member at an outer end of said delivery conduit, and air gap means defining a substantially sealed air gap formed to substantially surround said delivery conduit for a substantial portion of the length thereof, said air gap means substantially preventing formation of condensation on exposed external surfaces of said faucet means.

2. The water station of claim 1 wherein said reservoir includes a faucet fitting, said delivery conduit having a threaded rear end for threaded connection to said faucet fitting, and a front end extending between said faucet fitting and said spigot, said air gap means substantially surrounding a substantial portion of the length of said delivery conduit front end.

3. The water station of claim 2 wherein said faucet means further includes a raised annular shoulder formed on said delivery conduit, and an annular seal bushing carried about said delivery conduit in a position for axial compression between said raised shoulder and said faucet fitting when said threaded rear end of said delivery conduit is connected to said faucet fitting.

4. The water station of claim 3 wherein said air gap means comprises an annular outer sleeve formed on said delivery conduit and joined thereto at a position proximate to said spigot, said sleeve extending rearwardly from said spigot in generally annular spaced relation to said delivery conduit front end to define said air gap, and said sleeve terminating at a rear edge disposed generally coplanar with said raised shoulder, said seal bushing engaging said raised shoulder and said sleeve rear edge to substantially close and seal said air gap when said threaded rear end of said delivery conduit is connected to said faucet fitting.

5. The water station of claim 4 wherein said delivery conduit and said outer sleeve comprise a unitary plastic molding.

6. The water station of claim 2 wherein said faucet fitting is internally threaded, and wherein said threaded rear end of said delivery conduit comprises a threaded nipple.

7. The water station of claim 2 wherein said faucet fitting is disposed generally in alignment with a faucet port formed in said station housing when said reservoir is mounted within said station housing, said threaded rear end of said delivery conduit being receivable through said faucet port for connection to said faucet fitting, said delivery conduit front end and said spigot being exposed at the exterior of said station housing.

8. The water station of claim 7 wherein said faucet means further includes a raised annular shoulder formed on said delivery conduit, and an annular seal bushing carried about said delivery conduit in a position for axial compression between said raised shoulder and said faucet fitting when said threaded rear end of said delivery conduit is connected to said faucet fitting, said seal bushing extending through said faucet port.

9. A water station, comprising:

a reservoir having a hollow interior for receiving and supporting a supply of water;

a station housing having support means for receiving and supporting said reservoir;

chiller means within said station housing for chilling at least a portion of the water within said reservoir to provide a chilled water supply;

means for providing a supply of water from said reservoir at a substantially unchilled temperature; and faucet means for dispensing water from said reservoir, said faucet means comprising a pair of faucet valves each including a delivery conduit having an inner end for connection respectively to said chilled and unchilled water supplies, a spigot having a valve member at an outer end of said delivery conduit, and air gap means defining a substantially sealed air gap formed to substantially surround said delivery conduit for a substantial portion of the length thereof, said air gap means substantially preventing formation of condensation on exposed external surfaces of said faucet means.

10. A dispenser faucet for use in a bottled water station, said dispenser faucet comprising:

a delivery conduit having a rear end for connection to a reservoir containing a supply of water to be dispensed, and a front end projecting outwardly from said rear end and having a spigot with a manually operable valve member thereon, and air gap means defining a substantially sealed air gap formed to substantially surround said delivery conduit front end for a substantial portion of the length thereof.

11. The dispenser faucet of claim 10 wherein said delivery conduit rear end comprises a threaded nipple.

12. The dispenser faucet of claim 10 further including a raised annular shoulder formed about said delivery conduit at a position generally between said rear and front ends, wherein said air gap means comprises an outer sleeve formed on said delivery conduit and joined thereto at a position proximate to said spigot, said sleeve extending rearwardly from said spigot in generally annular spaced relation to said delivery conduit front end to define said air gap, and said sleeve terminating at a rear edge disposed generally coplanar with said raised shoulder, and seal means for sealing engagement with said raised shoulder and said sleeve rear edge to substantially close and seal said air gap.

13. The dispenser faucet of claim 12 wherein said seal means comprises a seal bushing carried about said delivery conduit rear end.

14. The dispenser faucet of claim 12 wherein said delivery conduit and said outer sleeve comprise a unitary plastic molding.

* * * * *